US010590880B2

(12) United States Patent
Higuchi et al.

(10) Patent No.: US 10,590,880 B2
(45) Date of Patent: Mar. 17, 2020

(54) CONTROLLER FOR INTERNAL COMBUSTION ENGINE

(71) Applicant: TOYOTA JIDOSHA KABUSHIKI KAISHA, Toyota-shi (JP)

(72) Inventors: Akihiko Higuchi, Toyota (JP); Tomohiro Nakano, Nagoya (JP); Eiji Murase, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 56 days.

(21) Appl. No.: 15/954,668

(22) Filed: Apr. 17, 2018

(65) Prior Publication Data

US 2018/0313291 A1 Nov. 1, 2018

(30) Foreign Application Priority Data

Apr. 28, 2017 (JP) ..... 2017-090003

(51) Int. Cl.
*F02D 41/30* (2006.01)
*F02D 41/04* (2006.01)
(Continued)

(52) U.S. Cl.
CPC ..... *F02D 41/3094* (2013.01); *F02D 41/047* (2013.01); *F02D 41/1401* (2013.01);
(Continued)

(58) Field of Classification Search
CPC ..... F02D 41/047; F02D 41/062–064; F02D 41/402–405; F02D 41/1401;
(Continued)

(56) References Cited

U.S. PATENT DOCUMENTS

2005/0109020 A1* 5/2005 Ichise ..... F02D 41/0235 60/285
2006/0207566 A1* 9/2006 Kobayashi ..... F02D 41/30 123/431
(Continued)

FOREIGN PATENT DOCUMENTS

JP 2004-324491 11/2004
JP 2006-37744 2/2006
(Continued)

*Primary Examiner* — Hung Q Nguyen
*Assistant Examiner* — Mark L. Greene
(74) *Attorney, Agent, or Firm* — Oblon, McClelland, Maier & Neustadt, L.L.P.

(57) ABSTRACT

After start-up of an internal combustion engine, a CPU divides a request injection amount, which is used to control the air-fuel ratio to a target value, into an amount of fuel injected by a port injection valve and an amount of fuel injected by a direct injection valve based on rotation speed and a load ratio. When the amount of fuel injected by the port injection valve changes from zero to greater than zero, the CPU decreases the actual fuel injection amount from the divided fuel injection amount then gradually increases to the divided fuel injection amount. When the amount of fuel injected by the port injection valve is gradually increased, the amount of fuel injected by the direct injection valve is increased from the divided fuel injection amount so that the request injection amount of fuel is injected by the port injection valve and the direct injection valve.

8 Claims, 6 Drawing Sheets

(51) Int. Cl.
*F02D 41/14* (2006.01)
*F02D 41/06* (2006.01)

(52) U.S. Cl.
CPC ..... *F02D 41/1439* (2013.01); *F02D 41/1445* (2013.01); *F02D 41/1454* (2013.01); *F02D 41/062* (2013.01); *F02D 2200/021* (2013.01); *F02D 2200/101* (2013.01)

(58) Field of Classification Search
CPC ..... F02D 41/1439; F02D 41/1445; F02D 41/1454; F02D 41/3094; F02D 2200/021; F02D 2200/101
See application file for complete search history.

(56) References Cited

U.S. PATENT DOCUMENTS

2009/0281709 A1 11/2009 Mallebrein et al.
2014/0244137 A1* 8/2014 Nakano ..... F02D 41/3094 701/104
2014/0251281 A1* 9/2014 Nakano ..... F02P 5/1502 123/478
2014/0261302 A1* 9/2014 Nakano ..... F02D 41/3094 123/295
2015/0345407 A1* 12/2015 Glugla ..... F02D 17/02 123/403
2015/0369161 A1* 12/2015 Nakano ..... F02D 41/402 123/480
2016/0377019 A1* 12/2016 Russ ..... F02D 41/3094 123/486

FOREIGN PATENT DOCUMENTS

JP 2008-169775 7/2008
JP 2009-270573 11/2009
JP 2010-90901 4/2010
WO WO 2012/014288 A1 2/2012

* cited by examiner

CONTROLLER FOR INTERNAL COMBUSTION ENGINE

BACKGROUND ART

The present invention relates to a controller for an internal combustion engine. A port injection valve, which injects fuel into an intake passage, and a direct injection valve, which injects fuel into a combustion chamber, each serve as a fuel injection valve supplying fuel into a cylinder. The internal combustion engine includes at least the port injection valve.

Japanese Laid-Open Patent Publication No. 2006-37744 discloses a controller for an internal combustion engine including a port injection valve, which injects fuel into an intake passage, and a direct injection valve, which injects fuel into a combustion chamber. The controller divides a request injection amount (EQMAX·klfwd), which is calculated based on an operating point of the internal combustion engine, between the port injection valve and the direct injection valve in accordance with an injection division ratio. When the injection division ratio is changed to increase the ratio of the injection amount of the port injection valve, the controller performs an increase correction on the port injection amount. This process is performed based on a consideration that an increase in the ratio of the injection amount of the port injection valve causes a larger amount of fuel to collect on the intake passage and therefore decreases the amount of fuel flowing into the combustion chamber from the port injection valve. In other words, the process is performed based on a consideration made to a situation in which the air-fuel ratio of an air-fuel mixture, which is subject to combustion in the combustion chamber, is leaner than the target value.

In addition to avoiding a situation in which the air-fuel ratio is excessively lean in the combustion chamber by performing the increase correction on the port injection valve, to avoid a situation in which the actual air-fuel ratio is richer than the target value, a necessary increase correction amount needs to be obtained with high accuracy. However, an increase correction amount obtained by the controller generally has an error. Thus, when the increase correction is performed on the port injection valve, the controllability of the air-fuel ratio in the combustion chamber may be lowered.

The above problem is not limited to an internal combustion engine that includes a port injection valve and a direct injection valve. The problem also occurs, for example, in an internal combustion engine that injects fuel from an injection port valve before the intake valve opens and then again injects fuel when the intake valve is open and also divides the request injection amount between two injections and changes the ratio of the injection amount. In this case, when the ratio of the amount of fuel injected from the port injection valve before the intake valve opens is increased, a larger amount of fuel collects on the intake passage. Thus, the air-fuel ratio of the air-fuel mixture in the combustion chamber may become leaner than the target value. Additionally, when the increase correction is performed to avoid the air-fuel ratio from becoming lean, an error in the increase correction may lower the controllability of the air-fuel ratio.

SUMMARY OF THE INVENTION

It is an object of the present invention to provide a controller for an internal combustion engine that limits lowering of the air-fuel ratio controllability.

To solve the above problem, a first aspect of the present invention provides a controller for an internal combustion engine. A port injection valve that injects fuel into an intake passage and a direct injection valve that injects fuel into a combustion chamber each serve as a fuel injection valve that supplies fuel into a cylinder, and the internal combustion engine includes at least the port injection valve. The controller performs a first fuel injection process injecting fuel by operating the port injection valve, a second fuel injection process including one of a process operating the port injection valve when the first fuel injection process is completed and an intake valve is open and a process operating the direct injection valve, a division process variably setting a division ratio, which divides a request injection amount of the internal combustion engine into a first request amount for the first fuel injection process and a second request amount for the second fuel injection process, based on an operating point of the internal combustion engine, and a gradual increase process. When the first request amount corresponding to the division process does not exist, the gradual increase process specifies the first request amount to be zero. When the first request amount is increased, the gradual increase process sets an instruction value of a fuel injection amount of the first fuel injection process to gradually increase to the first request amount based on a decreased amount from the first request amount and also sets an instruction value of a fuel injection amount of the second fuel injection process based on an increased amount of the second request amount to compensate for a shortage amount of a sum of the decreased amount and the second request amount with respect to the request injection amount.

Other aspects and advantages of the embodiments will become apparent from the following description, taken in conjunction with the accompanying drawings, illustrating by way of example the principles of the invention.

BRIEF DESCRIPTION OF THE DRAWINGS

The embodiments, together with objects and advantages thereof, may best be understood by reference to the following description of the presently preferred embodiments together with the accompanying drawings in which.

DESCRIPTION OF THE EMBODIMENTS

First Embodiment

A first embodiment of a controller for an internal combustion engine will now be described with reference to FIGS. 1 to 3C.

Figure 1:
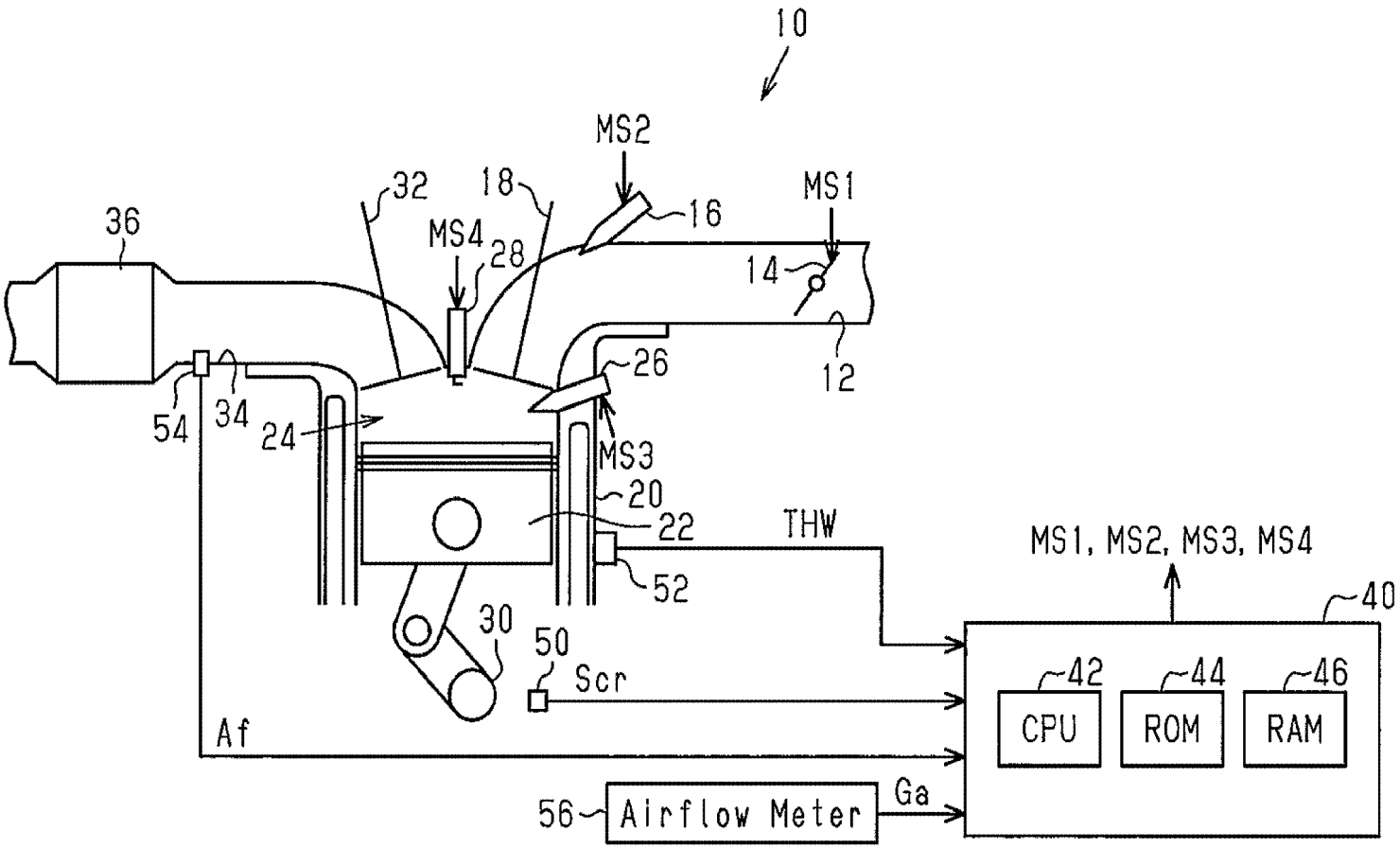
FIG. 1 is a diagram showing a first embodiment of a controller for an internal combustion engine and the internal combustion engine according to the present invention.

As shown in FIG. 1, an internal combustion engine 10 includes an intake passage 12 in which a throttle valve 14 is arranged to adjust the cross-sectional area of the passage. A port injection valve 16 is arranged at the downstream side of the throttle valve 14 to inject fuel into the intake passage 12. The air drawn into the intake passage 12 and the fuel injected from the port injection valve 16 flow into a combustion chamber 24 when an intake valve 18 opens. The combustion chamber 24 is defined by a cylinder 20 and a piston 22. A direct injection valve 26, which injects fuel into the combustion chamber 24, and an ignition device 28 project into the combustion chamber 24. The combustion chamber 24 is supplied with an air-fuel mixture of the air and the fuel that is injected from at least one of the port injection valve 16 and the direct injection valve 26. The air-fuel mixture is burned by spark discharge of the ignition device 28. The combustion energy is converted via the piston 22 into rotation energy of a crankshaft 30. The burned air-fuel mixture is discharged as an exhaust gas to an exhaust passage 34 when an exhaust valve 32 opens. The exhaust passage 34 includes a catalyst 36.

The internal combustion engine 10 is controlled by a controller 40. Since the controller 40 controls control amounts (e.g., torque and emission components) of the internal combustion engine 10, the controller 40 operates operating subject devices such as the throttle valve 14, the port injection valve 16, the direct injection valve 26, and the ignition device 28. Since the controller 40 controls the control amounts, the controller 40 refers to an output signal Scr of a crank angle sensor 50, a water temperature THW detected by a water temperature sensor 52, an air-fuel ratio Af detected by an air-fuel ratio sensor 54 based on emission components, and an intake air amount Ga detected by an airflow meter 56. The controller 40 includes a CPU 42, a ROM 44, and a RAM 46. As the CPU 42 runs programs stored in the ROM 44, the controller 40 controls the control amounts.

Figure 2:
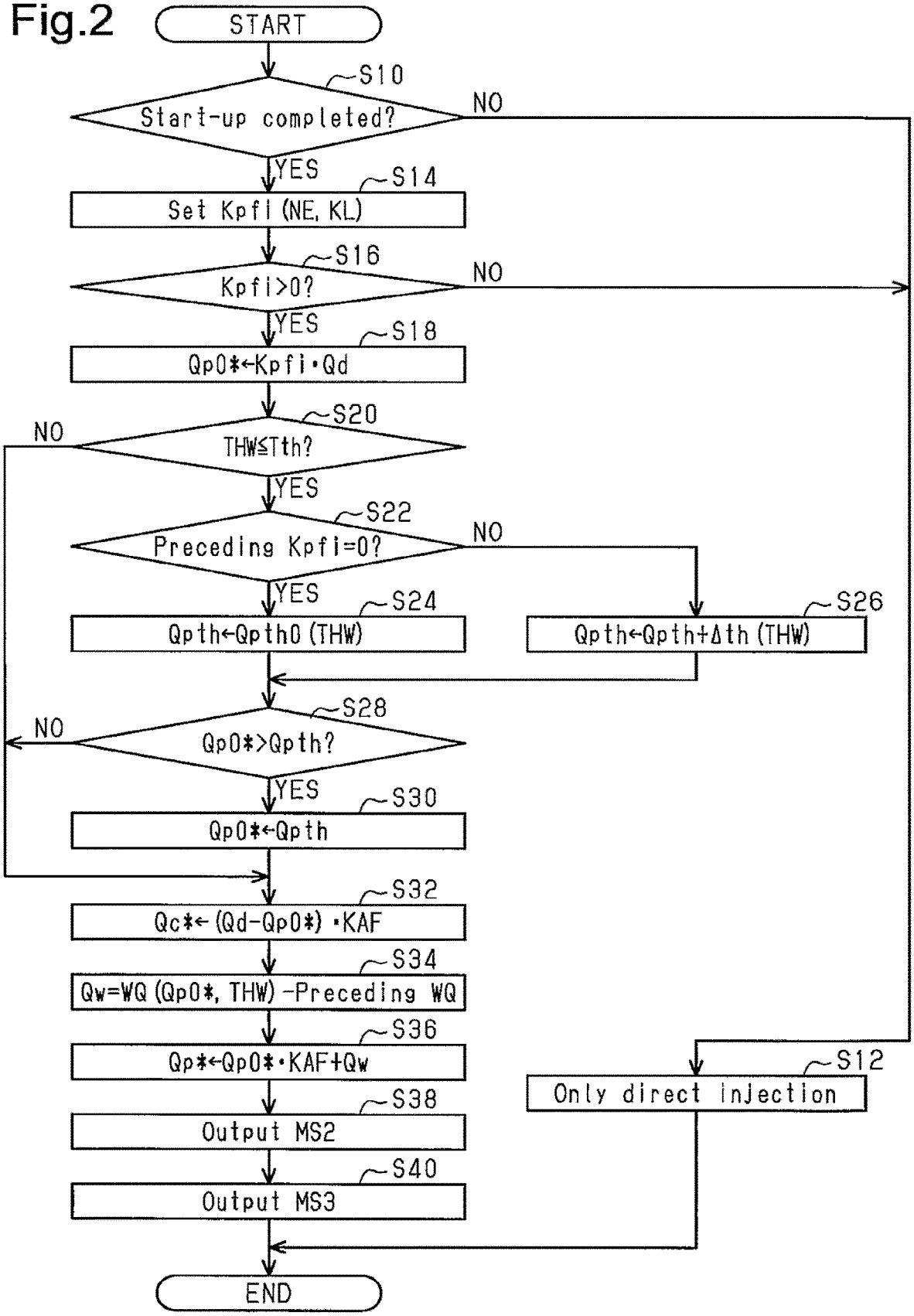
FIG. 2 is a flowchart showing the procedures of a fuel injection process.

The processes shown in FIG. 2 are performed when the CPU 42 repeatedly runs the programs stored in the ROM 44 on each of multiple cylinders in combustion cycles. Hereafter, numerals starting with "S" represent step numbers.

In the series of the processes shown in FIG. 2, the CPU 42 determines whether or not start-up of the internal combustion engine 10 is completed (S10). More specifically, the CPU 42 determines that the start-up is completed when a rotation speed NE calculated based on the output signal Scr is greater than or equal to a predetermined speed. When the CPU 42 does not determine that the start-up is completed (S10: NO), the CPU 42 performs the fuel injection process using only the direct injection valve 26 (S12). This improves the start-up because if the port injection valve 16 is used, the fuel collects on the intake passage 12 (more specifically, intake port), which lowers the controllability of the air-fuel ratio in the combustion chamber 24.

When the CPU 42 determines that the start-up is completed (S10: YES), the CPU 42 variably sets a division ratio (injection division ratio Kpfi), which divides a request injection amount Qd of fuel between the port injection valve 16 and the direct injection valve 26, based on the rotation speed NE and a load ratio KL (S14). More specifically, the injection division ratio Kpfi is the ratio of the injection amount of the port injection valve 16 to the request injection amount Qd and is a value of greater than or equal to zero and less than or equal to one. The port injection valve 16 performs a fuel injection before the intake valve 18 opens. The load ratio KL is the ratio of an intake air amount per a single combustion cycle of a cylinder to the maximum intake air amount. The maximum intake air amount is an intake air amount in a single combustion cycle of a cylinder when the open degree of the throttle valve 14 is maximal. The maximum intake air amount may be variably set in accordance with the rotation speed NE. More specifically, the ROM 44 may store map data specifying the relationship between the injection division ratio Kpfi, as an output variable, and the rotation speed NE and the load ratio KL, as input variables, so that the CPU 42 calculates the injection division ratio Kpfi based on the map data. The map data is combination data of discrete values of the input variables and values of the output variable corresponding to the values of the input variables. In this case, when the value of an input variable matches any one of the values of the input variables in the map data, the value of the corresponding output variable in the map data is the calculation result. When the value of the input variable does not match any one of the values of the input variables in the map data, the calculation result may be a value obtained by interpolating the values of multiple output variables contained in the map data.

The map data is adjusted to optimize, for example, the fuel economy and emission properties, taking into consideration the following point. More specifically, the fuel injection performed by the port injection valve 16 has a merit increasing the mixing degree of the air and the fuel in the combustion chamber 24 as compared to the fuel injection performed by the direct injection valve 26. As compared to the fuel injection performed by the port injection valve 16, the fuel injection performed by the direct injection valve 26 has a merit enhancing the cooling effect in the combustion chamber 24 due to latent heat of evaporation and thereby easily increasing the charging efficiency. More specifically, the injection division ratio Kpfi may be set to one at a low rotation speed with a low load, the injection division ratio Kpfi may be set to zero at a high rotation speed with a high load, and the injection division ratio Kpfi may be set to a value between zero and one at an intermediate rotation speed with an intermediate load.

Then, the CPU 42 determines whether or not the injection division ratio Kpfi is greater than zero (S16). When the CPU 42 determines that the injection division ratio Kpfi is zero (S16: NO), the CPU 42 proceeds to the process of S12.

When the CPU 42 determines that the injection division ratio Kpfi is greater than zero (S16: YES), the CPU 42 calculates a port request amount Qp0*, which is a request amount of injection from the port injection valve 16, by multiplying the request injection amount Qd and the injection division ratio Kpfi (S18). The CPU 42 calculates the request injection amount Qd, which serves as an operation amount so that open-loop control causes the air-fuel ratio of the air-fuel mixture in the combustion chamber 24 to approach its target value Af*, based on the amount of air filled in the combustion chamber 24. In this case, taking into consideration that as the water temperature THW is decreased, a larger amount of fuel collects on the wall surface of the cylinder 20 and is not included in the air-fuel mixture in the combustion chamber 24, the CPU 42 may set the request injection amount Qd to a greater value as the water temperature THW is decreased under a condition in which the combustion chamber 24 is filled with the same amount of air. The port request amount Qp0* is the fuel amount assigned to the port injection valve 16 so that the air-fuel ratio of the air-fuel mixture in the combustion chamber 24 approaches the target value Af*.

The CPU 42 determines whether or not the water temperature THW is less than or equal to a threshold value Tth (S20). This process determines whether or not a significant amount of fuel collects on the intake passage 12. The threshold value Tth is set to a temperature of an upper limit value for an intolerable state in which the fuel easily collects on the intake passage 12. When the CPU 42 determines that the water temperature THW is less than or equal to the threshold value Tth (S20: YES), the CPU 42 determines whether or not the preceding value of the injection division ratio Kpfi is zero (S22). This process determines whether or not the controllability of the air-fuel ratio particularly tends to be lowered if the port injection valve 16 is operated in accordance with the process of S18. More specifically, when the preceding value of the injection division ratio Kpfi is zero, the port injection valve 16 did not inject the fuel in the preceding combustion cycle. Therefore, if the port injection valve 16 is operated in accordance with the process of S18, the amount of fuel collected on the intake passage 12 may be quickly increased. Consequently, the controllability of the air-fuel ratio of the air-fuel mixture in the combustion chamber 24 may particularly tend to be lowered. For example, when the affirmative determination is made in the process of S10 for the first time, the injection division ratio Kpfi was not set in the process of S14 in the previous control cycles. In such a case, the preceding value of the injection division ratio Kpfi is specified to be zero.

When the CPU 42 determines that the preceding value of the injection division ratio Kpfi is zero (S22: YES), the CPU 42 assigns an initial value Qpth0 to an upper limit value Qpth, which is used to perform a guard process on the port request amount Qp0* (S24). The CPU 42 sets the initial value Qpth0 to a greater value as the water temperature THW is increased. This is because as the water temperature THW is increased, a smaller amount of fuel collects on the intake passage 12.

When the CPU 42 determines that the preceding value of the injection division ratio Kpfi is greater than zero (S22: NO), the CPU 42 corrects the upper limit value Qpth with an increase of an increase amount Δth (S26). The CPU 42 sets the increase amount Δth to a greater value as the water temperature THW is increased. This is because as the water temperature THW is increased, a smaller amount of fuel collects on the intake passage 12.

When the processes of S24, S26 are completed, the CPU 42 determines whether or not the port request amount Qp0* is greater than the upper limit value Qpth (S28). When the CPU 42 determines that the port request amount Qp0* is greater than the upper limit value Qpth (S28: YES), the CPU 42 assigns the upper limit value Qpth to the port request amount Qp0* (S30).

When the process of S30 is completed or when the negative determination is made in the processes of S20, S28, the CPU 42 calculates a direct injection instruction value Qc*, which is an instruction value of the injection amount to the direct injection valve 26 (S32). More specifically, the CPU 42 sets the direct injection instruction value Qc* to the product of a feedback operation amount KAF and a value "Qd−Qp0*," which is obtained by subtracting the port request amount Qp0* from the request injection amount Qd. The feedback operation amount KAF is an operation amount used in feedback control performed on the air-fuel ratio Af to the target value Af*. The CPU 42 uses the difference between the air-fuel ratio Af and the target value Af* as an input and sets the feedback operation amount KAF to the sum of output values of a proportional element, an integral element, and a derivative element. The value "Qd−Qp0*" is the fuel amount assigned to the direct injection valve 26 so that the air-fuel ratio of the air-mixture in the combustion chamber 24 approaches the target value Af*. Thus, the direct injection instruction value Qc* is the value obtained by performing the feedback correction on the fuel amount assigned to the direct injection valve 26.

The CPU 42 calculates a wet correction amount Qw (S34). The CPU 42 sets the wet correction amount Qw to a value obtained by subtracting the preceding value of a port collection amount WQ from the present value of the port collection amount WQ to obtain the amount of change in the fuel amount collected on the intake passage 12 in the single combustion cycle. The port collection amount WQ is an estimated value of the amount of fuel collected on the intake passage 12. The CPU 42 calculates the port collection amount WQ based on the port request amount Qp0* and the water temperature THW. More specifically, the CPU 42 performs calculation so that as the port request amount Qp0* is increased, the port collection amount WQ is increased. Additionally, the CPU 42 performs calculation so that as the water temperature THW is increased, the port collection amount WQ is decreased. More specifically, the ROM 44 may store map data specifying the relationship between the port collection amount WQ, as an output variable, and the port request amount Qp0* and the water temperature THW, as input variables, so that the CPU 42 calculates the port collection amount WQ based on the map data. In this case, the port collection amount WQ is calculated based on an assumption that the fuel has properties that particularly increase the amount of fuel collected on the intake passage 12. Such an assumption is made to certainly prevent an excessively lean air-fuel ratio in the combustion chamber 24 and a resulting misfire.

The CPU 42 calculates a port injection instruction value Qp*, which is an instruction value of the injection amount to the port injection valve 16, by adding the wet correction amount Qw to the product of the port request amount Qp0* and the feedback operation amount KAF (S36).

The CPU 42 transmits an operation signal MS2 to the port injection valve 16 so that the port injection valve 16 is operated to inject the amount of fuel corresponding to the port injection instruction value Qp* before the intake valve 18 opens (S38). Additionally, the CPU 42 transmits an operation signal MS3 to the direct injection valve 26 so that the direct injection valve 26 is operated to inject the amount of fuel corresponding to the direct injection instruction value Qc* during an intake stroke (S40). When the processes of S12, S40 are completed, the CPU 42 temporarily ends the series of the processes shown in FIG. 2.

The operation of the present embodiment will now be described.

When the port injection valve 16 injects the fuel for the first time after a start-up completion, the CPU 42 decreases the actual amount of fuel injected by the port injection valve 16 from the request amount obtained based on the injection division ratio Kpfi and the request injection amount Qd. Then, the CPU 42 gradually increases the actual amount of the fuel injection toward the request amount obtained based on the injection division ratio Kpfi and the request injection amount Qd (S24, S26). This limits a quick increase in the amount of fuel collected on the intake passage 12 immediately after the port injection valve 16 starts the fuel injection.

Figure 3A:
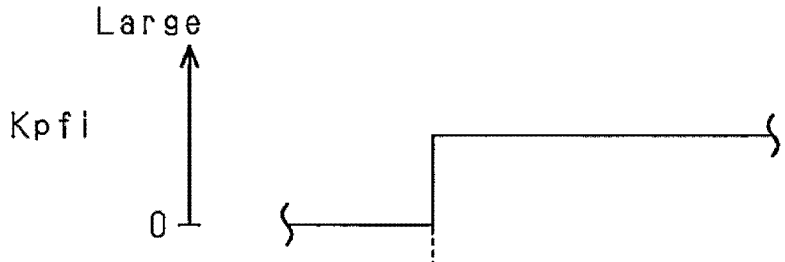
FIGS. 3A to 3C are time charts showing the fuel injection process.
Figure 3B:
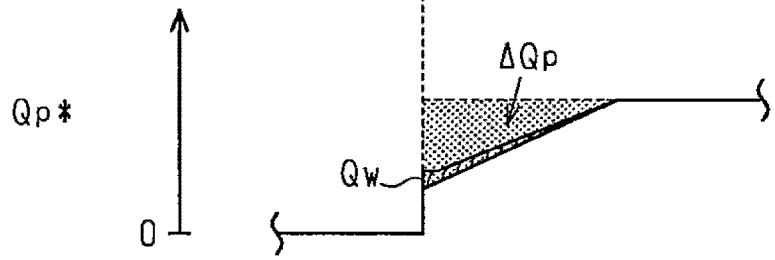

FIG. 3A shows changes in the injection division ratio Kpfi. FIG. 3B shows changes in the port injection instruction value Qp*. Here, the direct injection valve 26 injects a decreased amount ΔQp obtained by the processes of S28, S30 performed on the port request amount Qp0* calculated in the process of S18.

As described above, in the first embodiment, the amount of fuel injected from the port injection valve 16 is gradually increased. Thus, the amount of fuel collected on the intake passage 12 resists a quick increase immediately after the port injection valve 16 starts the fuel injection. This limits lowering of the controllability of the air-fuel ratio of the air-fuel mixture caused by changes in the amount of fuel collected on the intake passage 12.

Figure 3C:
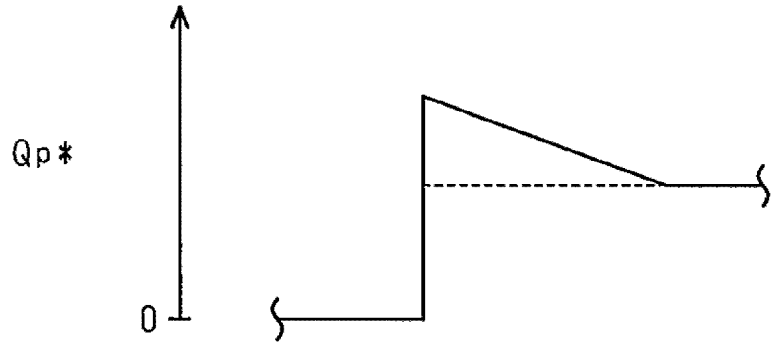

FIG. 3C shows a comparative example of a fuel injection process performed on the port injection valve 16. The processes of S20 to S30 of FIG. 2 are omitted from the comparative example. In this case, immediately after the port injection valve 16 starts the fuel injection, the sum of the wet correction amount and the port request amount Qp0* that is calculated in S18 and then corrected using the feedback operation amount KAF is used as the port injection instruction value Qp*. In this case, the amount of fuel injected from the port injection valve 16 is largely increased immediately after the port injection valve 16 starts the fuel injection. Thus, the amount of fuel that does not flow into the combustion chamber 24 and collects on the intake passage 12 quickly increases in the injected combustion cycle. To avoid a situation in which the air-fuel ratio of the air-fuel mixture is excessively lean in the combustion chamber 24, the wet correction amount also needs to be overly increased as compared to the first embodiment. Consequently, the fuel amount is increased by errors of the wet correction amount, which lowers the controllability of the air-fuel ratio of the air-fuel mixture in the combustion chamber 24.

In this case, the advantage of limiting the lowering of the air-fuel ratio controllability as compared to the comparative example is not limited to when the port injection valve 16 starts the fuel injection for the first time after a start-up. The advantage is also obtained when the injection division ratio Kpfi is changed from zero to a value of greater than zero.

The first embodiment further has the advantages described below.

(1) The port injection instruction value Qp* is calculated by correcting "Qp0*·KAF" with the wet correction amount Qw. Thus, as compared to when the correction with the wet correction amount Qw is not performed, a situation in which the air-fuel ratio of the air-fuel mixture in the combustion chamber 24 is excessively lean is avoided while maximizing the initial value Qpth0 and the increase amount Δth. This allows the port injection instruction value Qp* to be quickly changed to the value corresponding to the injection division ratio Kpfi.

Further, the guard process is performed on the port request amount Qp0*. This limits increases in the wet correction amount Qw. Accordingly, the error of the wet correction amount Qw will not be increased. This limits lowering of the controllability of the air-fuel ratio.

(2) When the start-up of the internal combustion engine 10 is completed, the injection division ratio Kpfi is set to be greater than zero. When the start-up of the internal combustion engine 10 is incomplete, the fuel injection is performed by only the direct injection valve 26. As compared to when the fuel injection is performed by the port injection valve 16 during the start-up of the internal combustion engine 10, the amount of fuel collected on the intake passage 12 is decreased during the start-up. Thus, the start-up performance of the internal combustion engine 10 will not be adversely affected.

(3) As the temperature of the internal combustion engine 10 is increased, the initial value Qpth0 and the increase amount Δth are increased. This increases the speed at which the upper limit value Qpth is gradually increased to the port request amount Qp0* calculated in the process of S18. Therefore, while reducing the amount of fuel collected on the intake passage 12, the injection amount is quickly changed in accordance with the injection division ratio Kpfi.

(4) When the guard process is performed using the upper limit value Qpth, the air-fuel ratio Af is feedback controlled to the target value Af*. When the guard process is performed using the upper limit value Qpth, the difference between the amount of fuel injected from the port injection valve 16 and the amount of fuel flowing from the intake passage 12 into the combustion chamber 24 is smaller than when the guard process is not performed. Thus, as compared to when the guard process is not performed, the error of the air-fuel ratio Af with respect to the target value Af* is not easily increased. The erroneous amount of the air-fuel ratio is quickly and appropriately corrected by the feedback control.

(5) When the water temperature THW is less than or equal to the threshold value Tth, the port request amount Qp0* is limited. When the water temperature THW is greater than the threshold value Tth, a small amount of fuel collects on the intake passage 12. Thus, the fuel collected on the intake passage 12 is considered to have a small effect on the controllability of the air-fuel ratio. Therefore, when the water temperature THW is greater than the threshold value Tth, the port request amount Qp0* is not limited. This allows the fuel injection to be quickly performed in accordance with the injection division ratio Kpfi.

Second Embodiment

A second embodiment will now be described with reference to FIGS. 4 to 6 focusing on the differences from the first embodiment.

Figure 4:
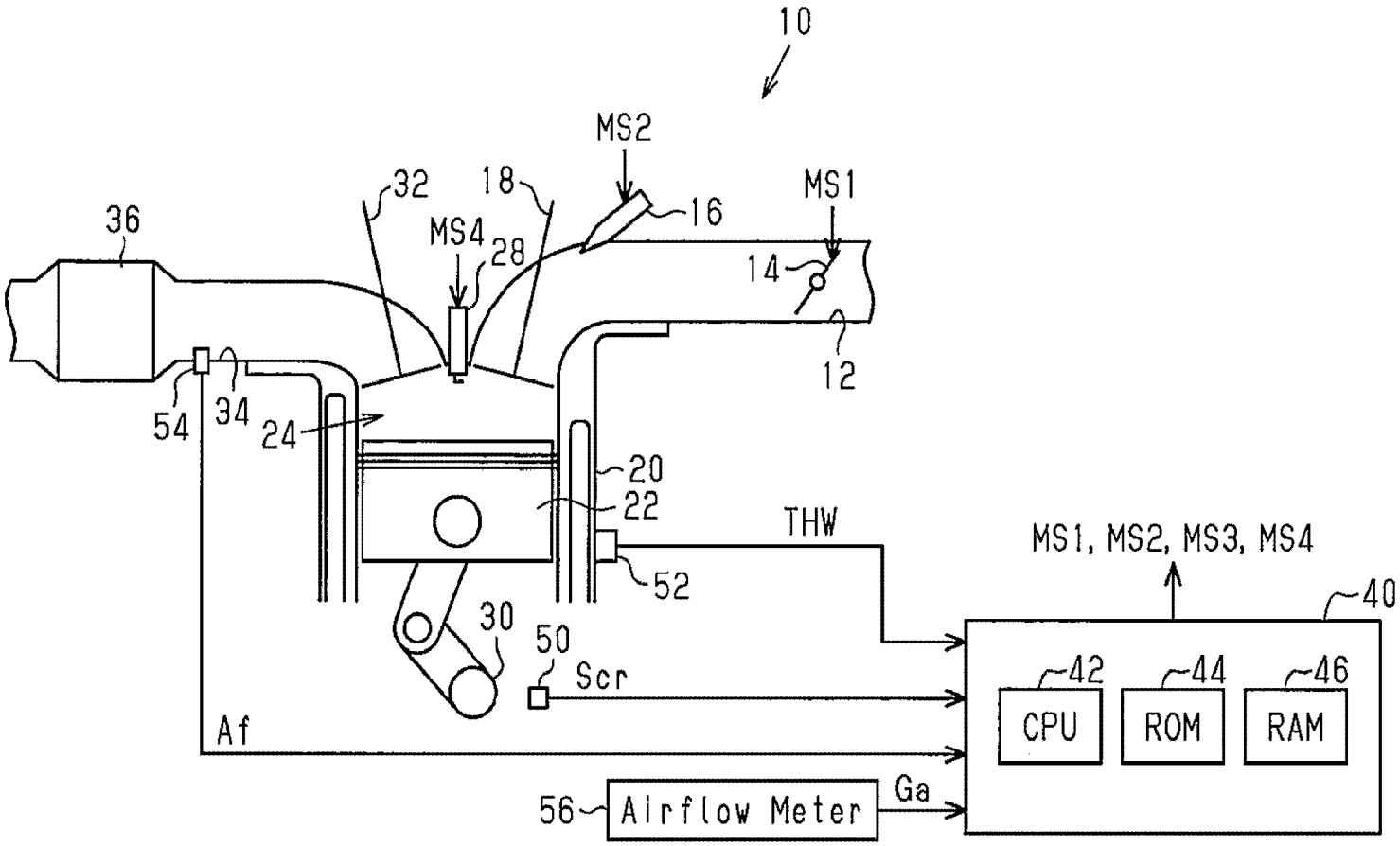
FIG. 4 is a diagram showing a second embodiment of a controller for an internal combustion engine and the internal combustion engine according to the present invention.

In FIG. 4, the same reference characters are given to those members that are the same as the corresponding members shown in FIG. 1 for the sake of simplicity. As shown in FIG. 4, in the second embodiment, the internal combustion engine 10 does not include the direct injection valve 26. Instead, the internal combustion engine 10 performs the fuel injection twice using the port injection valve 16.

Figure 5:
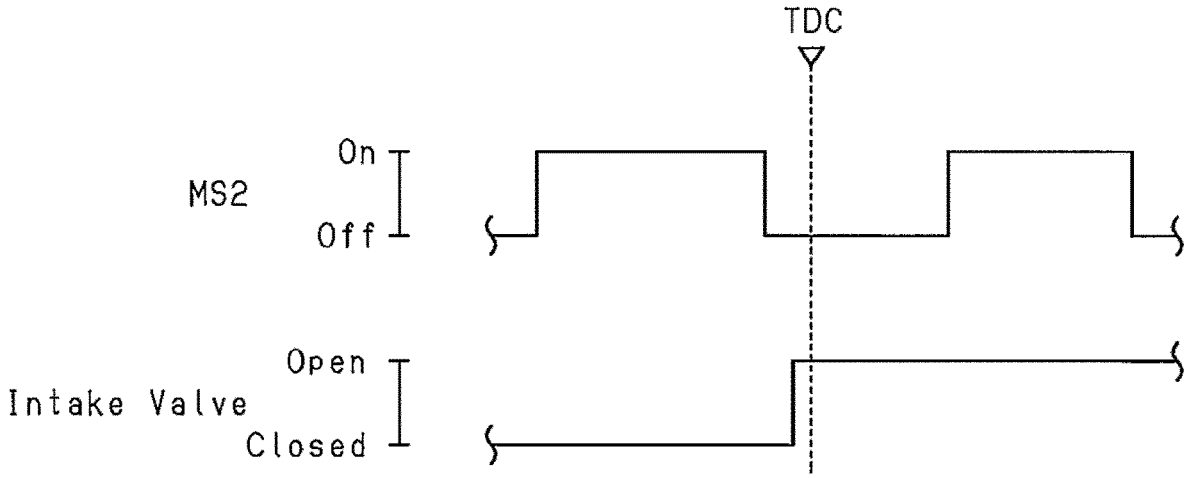
FIG. 5 is a time chart showing an intake asynchronous injection and an intake synchronous injection.

FIG. 5 indicates fuel injection periods when the operation signal MS2 is on. As shown in FIG. 5, in a period when the intake valve 18 is not open before an exhaust top dead center TDC, the port injection valve 16 performs an intake asynchronous injection, which is the first fuel injection. Then, in a period when the intake valve 18 is open after the exhaust top dead center TDC, the port injection valve 16 performs an intake synchronous injection, which is the second fuel injection. The intake synchronous injection is a fuel injection performed when the intake valve 18 is open and has a merit decreasing the amount of fuel collected on the intake passage 12. Additionally, as compared to the intake asynchronous injection, the cooling effect in the combustion chamber 24 is enhanced due to latent heat of evaporation. Thus, there is a merit easily increasing the charging efficiency. More specifically, the intake synchronous injection has the same merits as the fuel injection performed by the direct injection valve 26 of the first embodiment.

Figure 6:
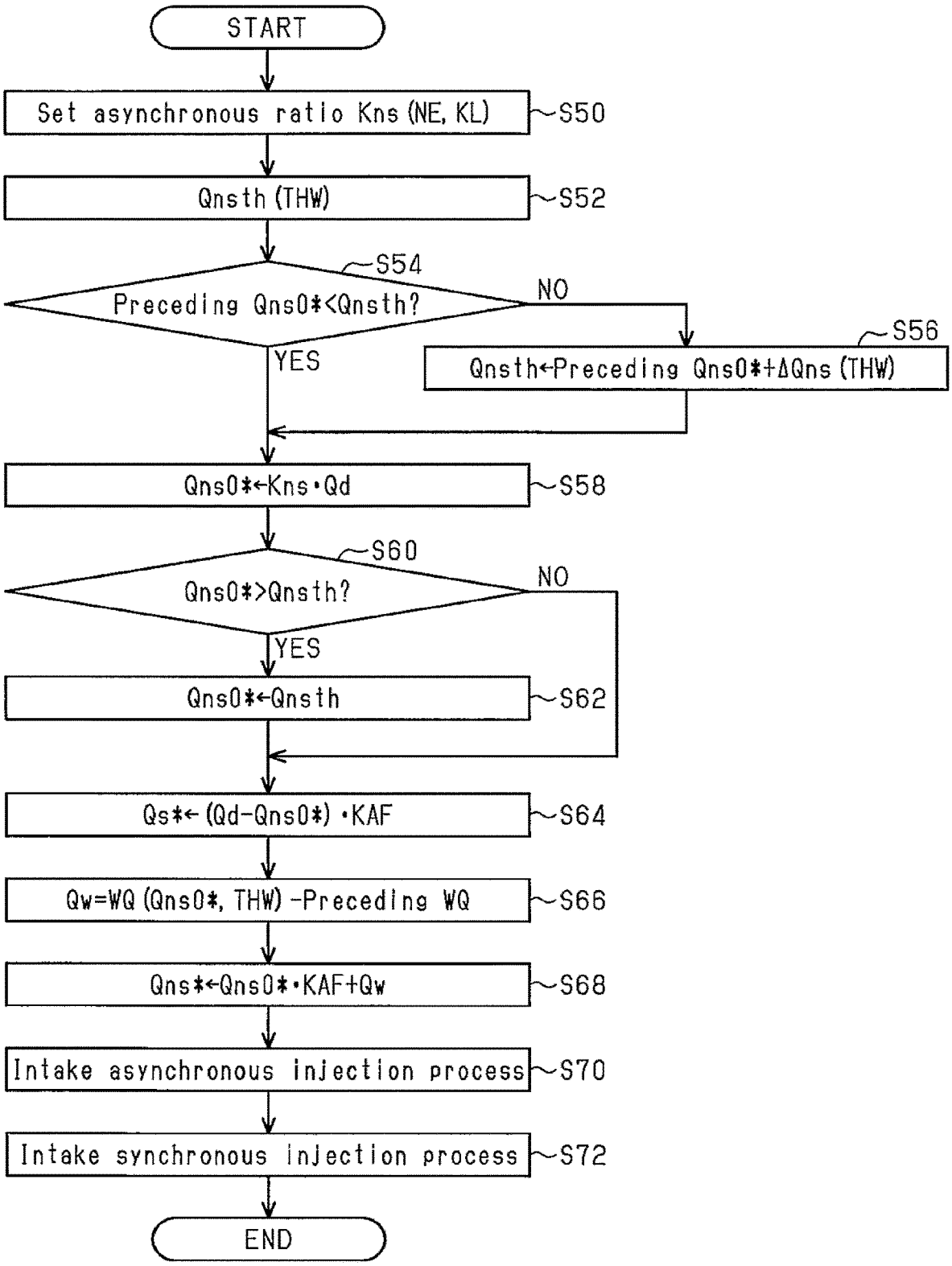
FIG. 6 is a flowchart showing the procedures of a fuel injection process.

The processes shown in FIG. 6 are performed when the CPU 42 repeatedly runs the programs stored in the ROM 44 on each cylinder in combustion cycles.

In the series of the processes shown in FIG. 6, the CPU 42 variably sets an asynchronous ratio Kns, which is the ratio of the intake asynchronous injection to the request injection amount Qd, based on the rotation speed NE and the load ratio KL (S50). More specifically, the ROM 44 may store map data specifying the relationship between the asynchronous ratio Kns, as an output variable, and the rotation speed NE and the load ratio KL, as input variables, so that the CPU 42 calculates the asynchronous ratio Kns based on the rotation speed NE and the load ratio KL of the map data. The map data is adjusted to optimal values taking into consideration that the intake asynchronous injection increases the air-fuel mixing degree and that the intake synchronous injection increases the charging efficiency.

The CPU 42 calculates an upper limit value Qnsth of the fuel amount of the intake asynchronous injection allowing for an assumption that the fuel will not significantly collect on the intake passage 12 (S52). More specifically, the CPU 42 sets the upper limit value Qnsth to a greater value as the water temperature THW is increased. More specifically, the ROM 44 may store map data specifying the relationship between the water temperature THW, as an input variable, and the upper limit value Qnsth, as an output variable, so that the CPU 42 calculates the upper limit value Qnsth based on the water temperature THW of the map data.

The CPU 42 determines whether or not the preceding value of an asynchronous request amount Qns0*, which is a request amount of the intake asynchronous injection amount, is less than the upper limit value Qnsth (S54). The asynchronous request amount Qns0* is the portion of the request injection amount Qd assigned to the intake asynchronous injection so that the air-fuel ratio approaches the target value Af*. When the CPU 42 determines that the preceding value is greater than or equal to the upper limit value Qnsth (S54: NO), the CPU 42 assigns a value obtained by adding an increase amount ΔQns to the preceding value of the asynchronous request amount Qns0* to the upper limit value Qnsth so that the upper limit value Qnsth is changed from the value calculated in the process of S52. The CPU 42 sets the increase amount ΔQns to a greater value as the water temperature THW is increased. More specifically, the ROM 44 may store map data specifying the relationship between the water temperature THW, as an input variable, and the increase amount ΔQns, as an output variable, so that the CPU 42 calculates the increase amount ΔQns based on the water temperature THW of the map data.

When the process of S56 is completed or when the affirmative determination is made in S54, the CPU 42 calculates the asynchronous request amount Qns0* by multiplying the request injection amount Qd by the asynchronous ratio Kns (S58). The CPU 42 determines whether or not the asynchronous request amount Qns0* is greater than the upper limit value Qnsth (S60). When the CPU 42 determines that the asynchronous request amount Qns0* is greater than the upper limit value Qnsth (S60: YES), the CPU 42 sets the asynchronous request amount Qns0* to the upper limit value Qnsth (S62).

When the process of S62 is completed or when the negative determination is made in S60, the CPU 42 assigns the product of the feedback operation amount KAF and a value of "Qd−Qns0*," obtained by subtracting the asynchronous request amount Qns0* from the request injection amount Qd, to a synchronous instruction value Qs*, which is an instruction value of the fuel injection amount of the intake synchronous injection (S64). The value "Qd−Qns0*" is the injection amount assigned to the intake synchronous injection so that the air-fuel ratio approaches the target value Af*.

The CPU 42 calculates the wet correction amount Qw (S66). In the same manner as the process of S34, the CPU 42 sets the wet correction amount Qw to a value obtained by subtracting the preceding value of the port collection amount WQ from the present value. The CPU 42 calculates the port collection amount WQ based on the asynchronous request amount Qns0* and the water temperature THW. The CPU 42 performs calculation so that as the asynchronous request amount Qns0* is increased, the port collection amount WQ is increased. Additionally, the CPU 42 performs calculation so that as the water temperature THW is increased, the port collection amount WQ is decreased.

The CPU 42 calculates an asynchronous instruction value Qns*, which is an instruction value of the intake asynchronous injection, by adding the wet correction amount Qw to the product of the asynchronous request amount Qns0* and the feedback operation amount KAF (S68).

Before the intake valve 18 opens, the CPU 42 transmits the operation signal MS2 to the port injection valve 16 to perform the intake asynchronous injection (S70). Then, after the intake valve 18 opens, the CPU 42 transmits the operation signal MS2 to the port injection valve 16 to perform the intake synchronous injection (S72). When the process of S72 is completed, the CPU 42 temporarily ends the series of the processes shown in FIG. 6.

As described above, in the second embodiment, when the asynchronous request amount Qns0* calculated in the process of S58 is increased from the preceding value, the asynchronous instruction value Qns* is gradually increased. This limits lowering of the controllability of the air-fuel ratio of the air-fuel mixture in the combustion chamber 24. Additionally, the advantages (1) and (3) to (5) of the first embodiment are also obtained.

Correspondence Relationship

The correspondence relationship between the items in the above embodiments and the items in the scope of the claims is as follows. Hereafter, the correspondence relationship will be described in accordance with the claim number of each claim.

[1] In claim 1, the first fuel injection process corresponds to the processes of S38, S70. The second fuel injection process corresponds to the processes of S40, S72. The division process corresponds to the processes of S14, S50. The gradual increase process corresponds to the processes of S22 to S32 or the processes of S54, S56, and S60 to S64. The first request amount corresponds to the port request amount Qp0* calculated in the process of S18 or the asynchronous request amount Qns0* calculated in the process of S58. The second request amount corresponds to a value obtained by subtracting the port request amount Qp0* calculated in the process of S18 from the request injection amount Qd or a value obtained by subtracting the asynchronous request amount Qns0* calculated in the process of S58 from the request injection amount Qd. The "shortage amount" corresponds to the difference between the port request amount Qp0* calculated in the process of S18 and the port request amount Qp0* (upper limit value Qpth0) calculated in the process of S30 or the difference between the asynchronous request amount Qns0* calculated in the process of S58 and the asynchronous request amount Qns0* (upper limit value Qnsth) calculated in the process of S62. The "increased amount of the second request amount" corresponds to "Qd−Qp0*" in the process of S32 when the affirmative determination is made in the process of S28 or "Qd−Qns0*" in the process of S64 when the affirmative determination is made in the process of S60.

[2] In claim 2, the wet correction amount calculation process corresponds to the processes of S34, S66.

[3] Claim 3 corresponds to the process of FIG. 2, particularly, the process of S16.

[4] In claim 4, the start-up determination process corresponds to the process of S10. The start-up process corresponds to the process of S12 when the negative determination is made in S10.

[5] Claim 5 corresponds to the process of FIG. 6.

[6] Claim 6 corresponds to the initial value Qpth0 in S24, the increase amount Δth in S26, and the increase amount ΔQns in S56 that are variably set in accordance with the water temperature THW.

[7] In claim 7, the feedback process corresponds to the processes of S32, S36 or the processes of S64, S68.

It should be apparent to those skilled in the art that the present invention may be embodied in many other specific forms without departing from the scope of the invention. Particularly, it should be understood that the present invention may be embodied in the following forms.

Gradual Increase Process

In the first embodiment, the increase amount Δth is variably set in accordance with the water temperature THW. However, the parameter for variably setting the increase amount Δth is not limited to the water temperature THW. For example, the increase amount Δth may be variably set based on the water temperature THW and at least one of the rotation speed NE and the load ratio KL serving as parameters. The relationship between the increase amount Δth and the rotation speed NE and the load ratio KL may be set so that as the amount of fuel collected on the intake passage 12 is decreased, the increase amount Δth is increased. Additionally, in this case, the ROM 44 may store map data based on set values. Further, a sensor may be provided to detect the pressure (intake manifold pressure) of the intake passage 12 at the downstream side of the throttle valve 14 so that the increase amount Δth is set to a greater value as the pressure is decreased. Additionally, the initial value Qpth0 is also variably set based on the parameters for variably setting the increase amount Δth h, which are described above.

In the first embodiment, the gradual increase process is performed when the water temperature THW is less than or equal to the threshold value Tth. Instead, the gradual increase process may be performed when the water temperature THW is greater than the threshold value Tth.

In the second embodiment, the increase amount ΔQns is variably set in accordance with the water temperature THW. However, the parameter for variably setting the increase amount ΔQns is not limited to the water temperature THW. For example, the increase amount Δth may be variably set based on the water temperature THW and at least one of the rotation speed NE and the load ratio KL serving as parameters. The relationship between the increase amount ΔQns and the rotation speed NE and the load ratio KL may be set so that as the amount of fuel collected on the intake passage 12 is decreased, the increase amount ΔQns is increased. Additionally, in this case, the ROM 44 may store map data based on set values. Further, a sensor may be provided to detect the pressure (intake manifold pressure) of the intake passage 12 at the downstream side of the throttle valve 14 so that the increase amount ΔQns is set to a greater value as the pressure is decreased. Additionally, the upper limit value Qnsth may be variably set based on the parameters for variably setting the increase amount ΔQns, which are described above.

In the second embodiment, the condition for performing the gradual increase process does not include the condition of the water temperature THW. However, as in the first embodiment, the condition in which the water temperature THW is less than or equal to the threshold value Tth may be considered.

The gradual increase process is not limited to the guard process performed on the request amount, which is described above. For example, when the affirmative determination is made in the process of S22 of FIG. 2, the port injection amount is gradually increased for the gradual increase process. Then, a value obtained by performing an upper limit guard process on the gradually increased port injection amount using the port request amount Qp0* calculated in the process of S18 may be used as the port request amount Qp0* in S36. In the first embodiment, when the injection division ratio Kpfi is further increased from a predetermined value of greater than zero, the gradual increase process may be performed.

Division Process

In the first embodiment, the injection division ratio Kpfi is variably set based on the operating point of the internal combustion engine 10 determined by the rotation speed NE and the load ratio KL. Instead, for example, the operating point may be determined by only one of the rotation speed NE and the load ratio KL. Alternatively, the injection division ratio Kpfi may be variably set in accordance with, for example, the water temperature THW, in addition to the rotation speed NE and the load ratio KL.

In the first embodiment, the divided injection between the port injection process and the direct injection process is performed when the start-up is completed. Instead, the divided injection may be performed during the start-up. Also, in this case, the lowering of the controllability of the air-fuel ratio of the air-fuel mixture in the combustion chamber 24 will be limited by setting the port injection instruction value Qp* based on the decreased amount from the port request amount Qp0* determined by the injection division ratio Kpfi.

The dependence of the injection division ratio Kpfi on the rotation speed NE and the load ratio KL is not limited to that described in the first embodiment.

In the second embodiment, the asynchronous ratio Kns is variably set based on the operating point of the internal combustion engine 10 determined by the rotation speed NE and the load ratio KL. Instead, for example, the operating point may be determined by only one of the rotation speed NE and the load ratio KL. Alternatively, the asynchronous ratio Kns may be variably set in accordance with, for example, the water temperature THW, in addition to the rotation speed NE and the load ratio KL.

Feedback Process

In the first embodiment, the request injection amount Qd in the processes of S18, S32 may be changed to the product of the request injection amount Qd and the feedback operation amount KAF. In this case, the multiplication process of the feedback operation amount KAF may be omitted from the processes of S32, S36.

In the first embodiment, the feedback control corrects both the port injection instruction value Qp* and the direct injection instruction value Qc*. Instead, for example, when the port injection instruction value Qp* is corrected, the direct injection instruction value Qc* does not have to be corrected. Additionally, the operation signal MS2 based on the port instruction value (Qp0*+Qw) prior to the correction by the feedback control may be corrected. The operation signal MS3 based on the direct injection instruction value (Qd−Qp0*) prior to the correction by the feedback control may be corrected.

In the second embodiment, the request injection amount Qd in the processes of S58, S64 may be changed to the product of the request injection amount Qd and the feedback operation amount KAF. In this case, the multiplication process of the feedback operation amount KAF can be omitted from the processes of S64, S68.

In the second embodiment, the feedback control corrects both the asynchronous instruction value Qns* and the synchronous instruction value Qs*. Instead, for example, when the asynchronous instruction value Qns* is corrected, the synchronous instruction value Qs* does not have to be corrected. Additionally, the operation signal MS2 based on the asynchronous instruction value (Qns0*+Qw) prior to the correction by the feedback control may be corrected. The operation signal MS2 based on the synchronous instruction value (Qd−Qs0*) prior to the correction by the feedback control may be corrected.

In the above embodiments, the feedback operation amount KAF is the sum of output values of a proportional element, an integral element, and a derivative element. Instead, the feedback operation amount KAF may be the sum of output values of the proportional element and the integral element. Additionally, the correction process of the feedback control does not necessarily have to be performed.

First Fuel Injection Process

In the first embodiment, the port injection process is performed before the intake valve 18 opens. Instead, the port injection process may be performed when the intake valve 18 is open.

Wet Correction Process

In the first embodiment, the wet correction amount Qw is corrected based on the port request amount Qp0*. Instead, for example, as described in the section of "Feedback Process," when the product of the request injection amount Qd and the feedback operation amount KAF is used instead of the request injection amount Qd in the processes of S18, S32, the wet correction amount Qw may be calculated based on an injection amount reflected by the feedback operation amount KAF. The calculation of the wet correction amount Qw based on the injection amount reflected by the feedback operation amount KAF is not limited to when the product of the request injection amount Qd and the feedback operation amount KAF is used instead of the request injection amount Qd in the processes of S18, S32.

In the second embodiment, the wet correction amount Qw is corrected based on the asynchronous request amount Qns0*. Instead, for example, as described in the section of "Feedback Process," when the product of the request injection amount Qd and the feedback operation amount KAF is used instead of the request injection amount Qd in the processes of S58, S64, the wet correction amount Qw may be calculated based on an injection amount reflected by the feedback operation amount KAF. The calculation of the wet correction amount Qw based on the injection amount reflected by the feedback operation amount KAF is not limited to when the product of the request injection amount Qd and the feedback operation amount KAF is used instead of the request injection amount Qd of the processes of S58, S64.

In the first and second embodiments, the port collection amount WQ is corrected based on the injection amount and the water temperature THW. Instead, for example, an accumulated air amount may be used as the parameter for indicating the temperature of the internal combustion engine instead of the water temperature THW.

In the above embodiments, the wet correction amount Qw is calculated so that the air-fuel ratio of the air-fuel mixture in the combustion chamber 24 will not be excessively lean regardless of the fuel properties. Instead, for example, when a process for calculating the fuel properties is performed or hardware is provided to acknowledge the fuel properties, the CPU 42 may obtain information related to the fuel properties and calculate the wet correction amount Qw based on the information.

The value obtained by subtracting the preceding value of the port collection amount WQ from the present value is used as the wet correction amount Qw. Instead, a value obtained by adding a predetermined positive value to the subtracted value may be used as the wet correction amount Qw. The positive value is a margin limiting a situation in which the air-fuel ratio of the air-fuel mixture is lean in the combustion chamber 24.

The parameter for calculating the wet correction amount Qw is not limited to the injection amount and the water temperature THW. For example, the rotation speed NE may be added. Additionally, when a mechanism that varies the timing for opening the intake valve 18 is provided, the valve open timing may be added.

In the first and second embodiments, an upper limit may be set when the correction process is performed using the wet correction amount Qw. The correction process using the wet correction amount Qw does not necessarily have to be performed. For example, in the process of FIG. 2, when the initial value Qpth0 and the increase amount Δth are set to sufficiently small values, the correction does not have to be performed using the wet correction amount Qw.

Controller

The controller is not limited to one including the CPU 42 and the ROM 44 and performing software processes. For example, the controller may include a dedicated hardware circuit (e.g., ASIC) that performs a hardware process on some of the software processes of the above embodiments. More specifically, the controller may have any one of the following configurations (a) to (c). Configuration (a) includes a processing device performing all of the above processes in accordance with programs and a program storage device storing the programs such as a ROM. Configuration (b) includes a processing device performing some of the above processes in accordance with programs, a program storage device, and a dedicated hardware circuit performing the remaining processes. Configuration (c) includes a dedicated hardware circuit performing all of the above processes. There may be multiple software processing circuits including the processing device and the program storage device and multiple dedicated hardware circuits. More specifically, the above processes may be performed by a processing circuit including at least one of one or multiple software processing circuits and one or multiple dedicated hardware circuits.

Others

FIG. 5 shows an example in which the timing for opening the intake valve 18 is advanced from the exhaust top dead center TDC. However, the timing is not limited to that shown.

The present examples and embodiments are to be considered as illustrative and not restrictive, and the invention is not to be limited to the details given herein, but may be modified within the scope and equivalence of the appended claims.

The invention claimed is:

1. A controller for an internal combustion engine including at least one of a port injection valve that injects fuel into an intake passage of a cylinder and a direct injection valve that injects fuel into a combustion chamber of the cylinder, the controller comprising:

processing circuitry configured to perform:

a first fuel injection process injecting fuel by operating the port injection valve, a second fuel injection process including one of a process operating the port injection valve when the first fuel injection process is completed and an intake valve is open and a process operating the direct injection valve, a division process variably setting a division ratio, which divides a request injection amount of the internal combustion engine into a first request amount for the first fuel injection process and a second request amount for the second fuel injection process, based on an operating point of the internal combustion engine, and a gradual increase process, wherein when the first request amount corresponding to the division process does not exist, the gradual increase process specifies the first request amount to be zero, and when the first request amount is increased, the gradual increase process sets an instruction value of a fuel injection amount of the first fuel injection process to gradually increase to the first request amount based on a decreased amount from the first request amount and also sets an instruction value of a fuel injection amount of the second fuel injection process based on an increased amount of the second request amount to compensate for a shortage amount of a sum of the decreased amount and the second request amount with respect to the request injection amount.

2. The controller for an internal combustion engine according to claim 1, wherein the processing circuitry is configured to perform a wet correction amount calculation process calculating a wet correction amount, which is an increase correction amount of the request injection amount and is used to perform an increase correction on the decreased amount, and the processing circuitry is configured to set, in the gradual increase process, the instruction value of the fuel injection amount of the first fuel injection process based on an amount obtained by performing the increase correction on the decreased amount from the first request amount using the wet correction amount.

3. The controller for an internal combustion engine according to claim 1, wherein the second fuel injection process is a process injecting fuel from the direct injection valve, and when the first request amount is changed from zero to greater than zero, the processing circuitry is configured to perform the gradual increase process.

4. The controller for an internal combustion engine according to claim 3, wherein the processing circuitry is configured to further perform:

a start-up determination process determining that start-up of the internal combustion engine is completed when a rotation speed of a crankshaft of the internal combustion engine is greater than or equal to a predetermined speed; and a start-up process injecting fuel from only the direct injection valve without using the port injection valve before the start-up determination process determines that the start-up is completed, wherein the processing circuitry is configured to perform the division process when the start-up determination process determines that the start-up is completed.

5. The controller for an internal combustion engine according to claim 1, wherein the first fuel injection process is a process injecting fuel from the port injection valve before the intake valve opens, and the second fuel injection process is the process injecting fuel from the port injection valve when the intake valve is open.

6. The controller for an internal combustion engine according to claim 1, wherein the processing circuitry is configured to perform the gradual increase process so that as a temperature of the internal combustion engine is increased, a gradual increasing speed to the first request amount is increased.

7. The controller for an internal combustion engine according to claim 1, wherein the processing circuitry is configured to perform a feedback process correcting at least one of an operation of the port injection valve in the first fuel injection process and an operation of one of the direct injection valve and the port injection valve in the second fuel injection process based on an operation amount used to perform feedback control on a detection value of an air-fuel ratio sensor, which is arranged in an exhaust passage of the internal combustion engine, to a target value.

8. The controller for an internal combustion engine according to claim 1, wherein the operating point is a rotation speed and a load ratio of the internal combustion engine.

* * * * *